US009689561B2

(12) United States Patent
Heinrich et al.

(10) Patent No.: US 9,689,561 B2
(45) Date of Patent: Jun. 27, 2017

(54) LIGHTING UNIT FOR A LARGE ELECTRICAL DEVICE

(75) Inventors: Alexander Heinrich, Villingen-Schwenningen (DE); Matthias Wiedenmann, Neenstetten (DE)

(73) Assignee: BSH Hausgeräte GmbH, Munich (DE)

( * ) Notice: Subject to any disclaimer, the term of this patent is extended or adjusted under 35 U.S.C. 154(b) by 587 days.

(21) Appl. No.: 13/880,381

(22) PCT Filed: Oct. 25, 2011

(86) PCT No.: PCT/EP2011/068652

§ 371 (c)(1),
(2), (4) Date: Apr. 19, 2013

(87) PCT Pub. No.: WO2012/062570

PCT Pub. Date: May 18, 2012

(65) Prior Publication Data

US 2013/0208446 A1 Aug. 15, 2013

(30) Foreign Application Priority Data

Nov. 8, 2010 (DE) ..... 10 2010 043 545

(51) Int. Cl.
*F21V 21/08* (2006.01)
*F25D 27/00* (2006.01)

(52) U.S. Cl.
CPC ..... *F21V 21/08* (2013.01); *F25D 27/00* (2013.01); *Y10T 29/49826* (2015.01)

(58) Field of Classification Search
CPC ..... F25D 27/00; F21V 17/164
USPC ..... 362/92
See application file for complete search history.

(56) References Cited

U.S. PATENT DOCUMENTS

| | | | | |
|---|---|---|---|---|
| 5,537,714 | A | 7/1996 | Lynch, Jr. et al. | |
| 6,150,622 | A | 11/2000 | Malnati | |
| 7,637,529 | B2 | 12/2009 | Tracht | |
| 2007/0223226 | A1* | 9/2007 | Park | 362/267 |

(Continued)

FOREIGN PATENT DOCUMENTS

| | | |
|---|---|---|
| CN | 1259199 | 7/2000 |
| CN | 2777465 | 5/2006 |

(Continued)

OTHER PUBLICATIONS

Chinese Search Report issued in corresponding Chinese Application No. 201180053784.9 dated Jul. 28, 2014.

(Continued)

*Primary Examiner* — Nimeshkumar Patel
*Assistant Examiner* — Christopher Raabe
(74) *Attorney, Agent, or Firm* — Nixon & Vanderhye P.C.

(57) ABSTRACT

A lighting unit for a large electrical household appliance includes a base part configured to receive a luminous element and having positive engagement elements, and a top part configured for attachment to the base part through displacement of the top part longitudinally in a connection plane relative to the base part. The top part has in displacement direction a front region which is provided with two gripping hooks for engagement with the positive engagement elements of the base part, with the gripping hooks engaging below the positive engagement elements.

20 Claims, 2 Drawing Sheets

(56) References Cited

U.S. PATENT DOCUMENTS

| | | | | |
|---|---|---|---|---|
| 2009/0056360 | A1 | 3/2009 | Krauss | |
| 2009/0086492 | A1* | 4/2009 | Meyer | 362/294 |

FOREIGN PATENT DOCUMENTS

| | | | |
|---|---|---|---|
| CN | 101194136 | | 6/2008 |
| CN | 201517747 | | 6/2010 |
| CN | 101836063 | | 9/2010 |
| DE | 29606772 | | 8/1996 |
| DE | 102006012922 | | 9/2007 |
| DE | 102009000667 | | 8/2010 |
| EP | 0615071 | | 9/1994 |
| EP | 0892230 | B1 | 10/2003 |
| EP | 1816421 | A2 | 8/2007 |
| JP | 2007285632 | A | 11/2007 |
| KR | 20020022302 | | 3/2002 |
| RU | 2383830 | | 3/2010 |
| WO | WO 2007/107401 | | 9/2007 |
| WO | WO 2010/089177 | | 8/2010 |

OTHER PUBLICATIONS

International Search Report PCT/EP2011/068652 dated Oct. 4, 2012.

Second Examination Report issued in corresponding Chinese Application No. 201180053845.1 dated May 6, 2015 (with translation).

* cited by examiner

LIGHTING UNIT FOR A LARGE ELECTRICAL DEVICE

BACKGROUND OF THE INVENTION

The present invention relates to a lighting unit for a large electrical appliance, comprising a base part which receives the luminous element and a top part which can be attached to the base part. The present invention relates in particular to an interior lighting unit for a refrigeration appliance.

A lighting unit of the type in question is known for example from DE 10 2006 013 231 U1. The lighting unit known herefrom has the disadvantage of taking up a relatively large amount of space, thereby rendering fitting difficult.

The published patent application EP 1 816 421 A2 shows a lighting module for a household appliance, with a lamp cover attached to a base body.

The published patent application EP 0 892 230 A1 shows a refrigeration appliance with an interior cover for a light. Attached to the interior cover are a top part and a base part, each on opposite sides of the cover.

The published patent application JP 2007 285 632 A shows a refrigeration appliance with a luminous element, which is attached to a plate. The plate, together with the luminous element, is attached in a displaceable manner to the top of the refrigeration appliance.

BRIEF SUMMARY OF THE INVENTION

One object of the invention is therefore to specify a lighting unit of the type in question which can be fitted in a simple manner.

This object is achieved by a lighting unit with the features of the invention. Preferred developments and embodiments are specified in the dependent claims. According to the independent claims the achievement of the object also extends to a refrigeration appliance and a method for fitting the inventive lighting unit. Preferred developments and embodiments will emerge correspondingly for these.

To achieve the object, a lighting unit is proposed, which comprises a base part which receives at least one luminous element and a top part which can be attached to the base part, with provision being made for a number of corresponding positive engagement elements to be arranged on the top part and on the base part, which serve to attach the top part to the base part, said positive engagement elements being able to be made to engage by displacing the top part longitudinally in the connection plane relative to the base part.

The connection plane is the separating plane (contact plane) that extends transversely and in particular perpendicular to the positioning direction between top part and base part. Because the positive engagement elements of the inventive lighting unit can be made to engage by displacing the top part longitudinally in the connection plane relative to the base part, the inventive lighting unit and in particular its top part can be embodied to be extremely flat, as there is no need for the conventional latching elements which are aligned transversely in relation to the separating plane and therefore stick out or the corresponding approach inclinations for their deflection, as shown for example in DE 10 2006 013 231 U1. The inventive lighting unit can therefore be fitted very simply and efficiently, in particular even in places that are difficult to access. Also the inventive lighting unit allows excellent attachment of the top part to the base part to be achieved after the positive engagement elements have been made to engage or have been closed. The top part can then no longer be raised. The achieved attachment of the top part to the base part also proves to be extremely secure during transportation.

Provision is preferably made for the engagement of the corresponding positive engagement elements to be able to be released non-destructively. Engagement release can be brought about by applying corresponding force to the top part, which can be done using a tool but preferably without the aid of a tool. The top part can thus be removed from the base part at any time, to replace a defective luminous element for example.

In one preferred embodiment of the inventive lighting unit at least two gripping hooks or the like are configured on the top part in the front region in respect of the displacement direction (for attachment purposes), it being possible to make said gripping hooks engage with corresponding positive engagement elements on the base part. Engagement is preferably brought about by the gripping hooks engaging below the positive engagement elements configured on the base part. Provision can also preferably be made for at least one recess to be configured on the top part in the rear region in respect of the displacement direction, in which recess corresponding gripping hooks or the like on the base part can engage. Provision is made for a number of gripping hooks configured on the base part to engage in this one recess on the top part.

At least one latching mechanism, which acts between top part and base part, is preferably provided on the inventive lighting unit, bringing about fixing of the top part relative to the base part. The fixing brought about by the latching mechanism is to prevent the possibility of the top part being pushed back easily counter to the displacement direction (for attachment purposes).

According to one advantageous embodiment of the invention provision is made for the top part and the base part to be held together in their engagement positions with a force fit, in particular by spring force, counter to the engagement direction in the engagement position. The securing force is preferably achieved by elastic deformation of the top part and/or base part.

According to one preferred embodiment said latching mechanism has a stiff latching projection configured on the base part and a stiff latching segment configured on the top part. "Stiff" here means that said latching elements are not configured as resilient in the otherwise usual manner. The latching segment on the top part and the latching projection on the base part slide onto one another when the top part is displaced longitudinally relative to the base part, hereby initially bringing about elastic deflection of the top part (top part being pressed away from the base part), until the latching segment on the top part can engage positively behind the latching projection on the base part, with the latching force being generated from the elastic deflection of the top part. Such rear engagement produces the fixing between top part and base part. The top part can then no longer be pushed back easily; it is first necessary to release the fixing by raising the top part, thereby cancelling the positive engagement between latching segment and latching projection, which is possible with a tool (for example with a slot-type screwdriver) but preferably without the aid of a tool.

Provision is preferably made for the top part to be a flat and smooth cover. The height of the cover is for example maximum 5 mm, preferably maximum 4 mm and in particular maximum 3 mm. Said cover is preferably formed at least partially from a light-permeable material. Provision is preferably also made for the base part to be a backing piece.

A backing piece serves to attach the lighting unit to a housing wall. To this end said backing piece is positioned behind a matching opening in the housing wall and is supported against the edge of said opening.

The top part and base part are preferably formed from a cold-resistant plastic material. In particular the base part is an injection molded single piece. The top part can also be an injection molded single piece or a multipart component made up of individual pieces joined together.

The achievement of the abovementioned object also extends to a refrigeration appliance, in particular a refrigerator, a wine storage cabinet or a freezer, having at least one inventive lighting unit. Said lighting unit can be in particular an interior lighting unit, which is arranged in the chilled interior, preferably on the inner container wall of the refrigeration appliance.

The achievement of the abovementioned object also extends to a method for fitting an inventive lighting unit on the housing wall of a large electrical appliance and in particular to a method for fitting an inventive lighting unit (interior lighting unit) on the inner container wall of a refrigeration appliance, with the base part being positioned on the housing wall first and the top part then being attached to the base part, to which end the top part is positioned on the base part and displaced in the connection plane relative to the base part, with the result that the corresponding positive engagement elements arranged on the top part and on the base part engage with one another.

BRIEF DESCRIPTION OF THE DRAWINGS

Further features and advantages of the invention will emerge from the exemplary description of an exemplary embodiment which follows, with reference to the accompanying figures, in which.

DETAILED DESCRIPTION OF EXEMPLARY EMBODIMENTS OF THE PRESENT INVENTION

The direction details used in the following relate to the diagrams shown in the figures.

Figure 1:
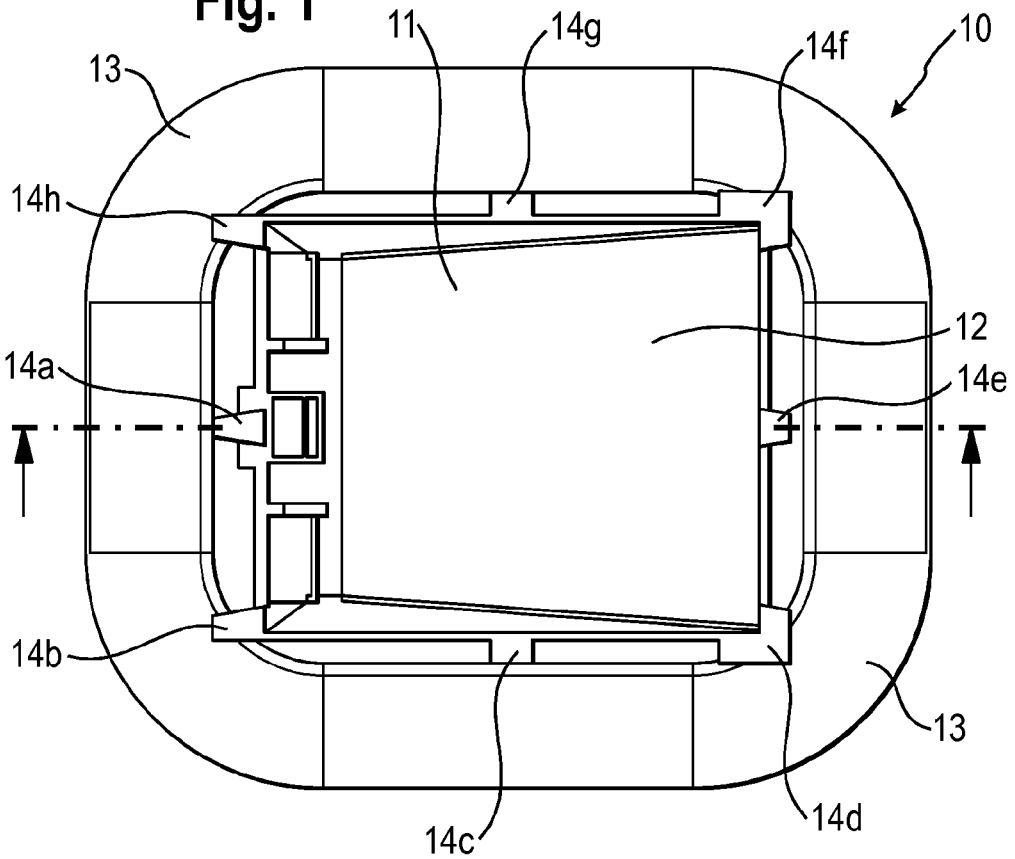
FIG. 1 shows the top view of the upper face of the base part of an inventive lighting unit.

FIG. 1 shows a base part of an inventive lighting unit designated as a whole as 10, being a so-called backing piece, as described above. The base part 10 has a body 11 to receive a luminous element (not shown). 12 designates a reflector segment integrated in the body 11. 14*a* to 14*h* designate holding elements, which serve to attach the base part 10 behind a matching opening in a housing wall, this being the subject matter of another patent application. 13 designates a peripheral sealing lip configured on the body to support the backing piece 10 on the housing wall and to seal the opening in the housing wall. The base part 10 is configured as a single injection molded plastic piece.

Figure 2:
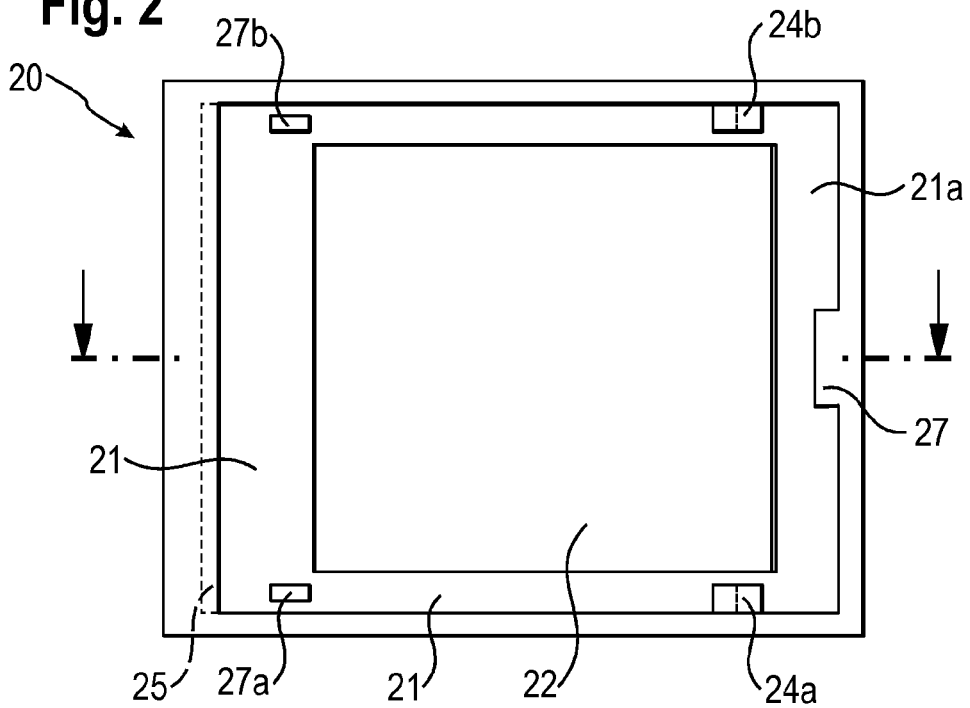
FIG. 2 shows a top view of the lower face of the top part associated with the base part from FIG. 1.

FIG. 2 shows a top part of the lighting unit associated with the base part 10 from FIG. 1 and designated as a whole as 20. The top part 20 has a frame 21 that is also configured as a single injection molded plastic piece, supporting a clear window 22. The frame 21 and window 22 are for example bonded and/or welded together. 24*a* and 24*b* designate two gripping hooks which are configured opposite one another on the two longitudinal sides of the frame 21. 25 designates a recess configured on the left wide side of the frame 21 and covered in the illustrated diagram, extending over almost the entire width of the top part 20. A latching segment 27 associated with a latching mechanism is configured on the right wide side 21*a* of the frame 21. Two spacers 27*a* and 27*b* for maintaining a distance from the base part 10 are also present on the frame 21.

To attach the top part 20 to the base part 10, said top part 20 is positioned on the base part 10 and then displaced in the connection plane, as described below in relation to FIG. 3. The sections illustrated in FIG. 3 correspond to the section profiles indicated in FIG. 1 and FIG. 2.

Figure 3:
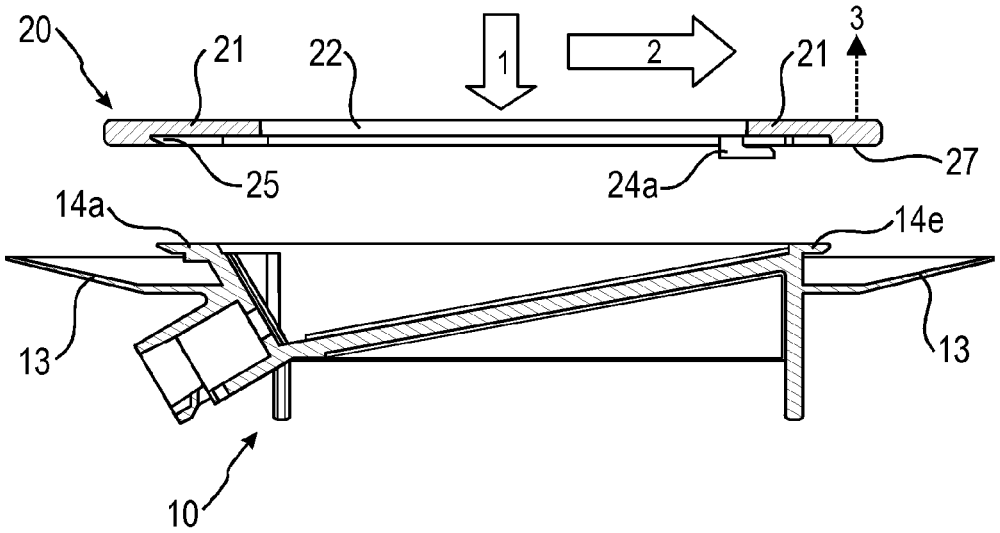
FIG. 3 shows the fitting of the top part from FIG. 2 to the base part from FIG. 1.

FIG. 3 shows the initial position for attaching the top part 20 to the base part 10. Starting from this initial position the top part 20 is positioned on the base part 10, as shown by the movement arrow 1. The top part 20 is then displaced to the right in the connection plane (see FIG. 4) relative to the base part 10, as shown by the movement arrow 2. During displacement the gripping hooks 24*a* and 24*b* engage below the holding elements 14*d* and 14*f* (see FIG. 1) of the base part 10 in the front region of the top part 20 in respect of the displacement direction 2. The holding elements 14*h*, 14*a* and 14*b* of the base part 10 (see FIG. 1) also engage in the recess 25 on the top part 20. The resulting engagement of the approximately evenly distributed positive engagement elements allows optimum attachment of the top part 20 to the base part 10 to be achieved in each segment. The illustrated configuration and arrangement of the positive engagement elements is however only exemplary. The holding elements 14*a*, 14*b*, 14*d*, 14*f* and 14*h* on the base part 10 serve on the one hand to attach the base part 10 to the housing wall and on the other hand to attach the top part 20 to the base part 10.

During the displacement of the top part 20 relative to the base part 10 in the displacement direction 2 the latching segment 27 on the top part 20 slides on the holding element 14*e* (see FIG. 1), which is configured as a latching projection, on the base part 10. This raises the front frame segment 21*a* of the top part 20 in respect of the displacement direction 2 in an elastic manner. As the gripping hooks 24*a* and 24*b* are already engaging below the corresponding positive engagement elements 14*d* and 14*f* of the base part 10, the front frame segment 21 deflects or arches upward, as shown by the arrow 3 in FIG. 3. This produces an elastic return force, which ensures that, when the top part 20 is displaced further in the displacement direction 2, the latching segment 27 can finally engage behind the latching projection or holding element 14*e* on the base part 10 in a positive manner, thereby perceptibly ending the displacement movement 2 and fixing the top part 20 to the base part 10. Stopping in a lateral direction is also brought about by the engagement of the gripping hooks 24*a* and 24*b* below the holding elements 14*d* and 14*f* and by the engagement of the holding elements 14*h* and 14*b* in the recess 25.

Figure 4:
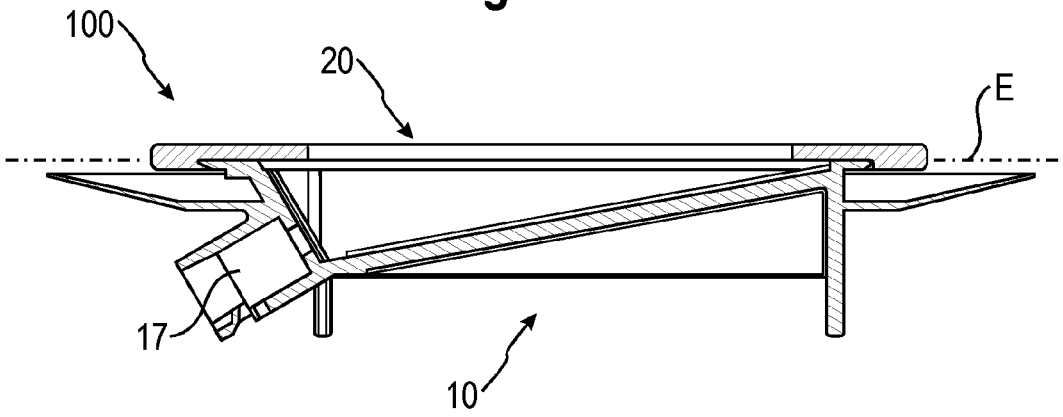
FIG. 4 shows the top part from FIG. 2 attached to the base part from FIG. 1.

FIG. 4 shows the top part 20 attached and fixed to the base part 10. The lighting unit formed from base part 10 and top part 20 is designated as a whole as 100. In FIG. 4 the connecting plane between top part 20 and base part 10 is shown with a dot-dash line and designated as E. FIG. 4 shows the flat and smooth configuration of the top part 20 clearly. When the lighting unit 100 is used as an interior light for a refrigeration appliance, the top part 20 only projects slightly into the interior of the refrigeration appliance, allowing effective space utilization in the interior of the refrigeration appliance. FIG. 4 also clearly shows the relatively small amount of space required by the base part 10, which allows for example easy fitting on a housing wall (not shown). 17 designates a connector piece on the base part 10 for electrical contact.

In order to be able to remove the top part 20 from the base part 10, the right or front frame segment 21*a* must first be raised to cancel the positive engagement between the latching segment 27 and the latching projection or holding element 14*e*. To facilitate the raising of the front frame segment 21*a*, a recess (or slot) can be configured on its lower face, to allow the engagement of a tool (e.g. a slot-type screwdriver). The top part 20 can then be pushed back in the direction counter to the displacement direction 2, with the positive engagement elements that are engaged (as described above) being disengaged. The top part 20 can then be raised from the base part 10.

The invention claimed is:

1. A lighting unit for a housing wall of a large electrical household appliance, comprising:

a base part configured to receive a luminous element and having positive engagement elements; and a top part configured to attach to the base part by a displacement of the top part relative to the base part in a connection plane, said top part having a front region provided with two gripping hooks for engagement with the positive engagement elements of the base part after the displacement, with the gripping hooks engaging below the positive engagement elements, wherein the connection plane is parallel to the housing wall and the displacement is towards the two gripping hooks.

2. The lighting unit of claim 1, constructed for a household refrigeration appliance.

3. The lighting unit of claim 1, wherein the gripping hooks releasably engage with the positive engagement elements in a non-destructive manner.

4. The lighting unit of claim 1, wherein the base part has gripping hooks for engagement in at least one recess provided in the top part.

5. The lighting unit of claim 1, further comprising at least one latching mechanism, which acts between the top part and the base part for fixing the top part relative to the base part.

6. The lighting unit of claim 1, wherein the top part and the base part are secured in their engagement position with a force fit in opposition to an engagement direction.

7. The lighting unit of claim 6, wherein the force fit is realized by spring force.

8. The lighting unit of claim 6, further comprising at least one latching mechanism, which acts between the top part and the base part for fixing the top part relative to the base part, said latching mechanism having a stiff latching projection on the base part and a stiff latching segment on the top part, wherein the latching projection of the top part and the latching segment of the base part slide onto one another when the top part is displaced longitudinally relative to the base part to thereby initially cause an elastic deflection of the top part to establish the force fit to secure the engagement position, until the latching segment is able to engage behind the latching projection.

9. The lighting unit of claim 1, wherein the top part is a flat and smooth cover with a surface configured to be parallel to the housing wall.

10. The lighting unit of claim 1, wherein the base part is a backing piece.

11. A refrigeration appliance, comprising:

a housing wall;

at least one lighting unit attached to the housing wall and including a base part configured to receive a luminous element and having positive engagement elements, and a top part configured to attach to the base part by a displacement of the top part relative to the base part in a connection plane, said top part having a front region formed with two gripping hooks for engagement with the positive engagement elements of the base part after the displacement, with the gripping hooks engaging below the positive engagement elements, wherein the connection plane is parallel to the housing wall and the displacement is towards the two gripping hooks.

12. A refrigeration appliance of claim 11, constructed in the form of a household refrigerator or freezer.

13. The refrigeration appliance of claim 11, wherein the gripping hooks releasably engage with the positive engagement elements in a non-destructive manner.

14. The refrigeration appliance of claim 11, wherein the base part has gripping hooks for engagement in at least one recess provided in the top part.

15. The refrigeration appliance of claim 11, wherein the lighting unit includes at least one latching mechanism, which acts between the top part and the base part for fixing the top part relative to the base part.

16. The refrigeration appliance of claim 11, wherein the top part and the base part are secured in their engagement position with a force fit in opposition to an engagement direction.

17. The refrigeration appliance of claim 16, wherein the force fit is realized by spring force.

18. The refrigeration appliance of claim 16, wherein the lighting unit includes at least one latching mechanism, which acts between the top part and the base part for fixing the top part relative to the base part, said latching mechanism having a stiff latching projection on the base part and a stiff latching segment on the top part, wherein the latching projection of the top part and the latching segment of the base part slide onto one another when the top part is displaced longitudinally relative to the base part to thereby initially cause an elastic deflection of the top part to establish the force fit to secure the engagement position, until the latching segment is able to engage behind the latching projection.

19. The refrigeration appliance of claim 11, wherein the top part is a flat and smooth cover with a surface parallel to the housing wall.

20. The refrigeration appliance of claim 11, wherein the base part is a backing piece.

* * * * *